US005792265A

United States Patent [19]

Maier et al.

[11] Patent Number: 5,792,265

[45] Date of Patent: Aug. 11, 1998

[54] DEVICE AND PROCESS FOR PRODUCING REINFORCING LAYERS ON CYLINDER RUNNING SURFACES OF INTERNAL COMBUSTION ENGINES AND THE LIKE

[75] Inventors: Kurt Maier, Leonberg; Helmut Hübner, Schwäbisch Gmünd; Ernst Pfleiderer, Backnang, all of Germany

[73] Assignee: Mahle GmbH, Stuttgart, Germany

[21] Appl. No.: 583,074

[22] PCT Filed: Jul. 15, 1993

[86] PCT No.: PCT/DE93/00627

§ 371 Date: Jan. 11, 1996

§ 102(e) Date: Jan. 11, 1996

[51] Int. Cl.[6] ..... B05C 5/00

[52] U.S. Cl. ..... 118/317; 118/408; 118/620; 427/230; 427/236; 427/239; 204/224 R; 204/237

[58] Field of Search ..... 118/317, 408, 118/620; 427/230, 236, 239, 528, 531; 204/224 R, 237

[56] References Cited

U.S. PATENT DOCUMENTS

| | | | |
|---|---|---|---|
| 4,441,976 | 4/1984 | Iemmi et al. | 204/224 R |
| 5,271,967 | 12/1993 | Kramer et al. | 427/236 |
| 5,468,295 | 11/1995 | Marantz et al. | 118/317 |
| 5,580,383 | 12/1996 | Ikegaya et al. | 118/317 |

FOREIGN PATENT DOCUMENTS

| | | |
|---|---|---|
| 1034447 | 7/1958 | Germany . |
| 39 37 763 | 5/1991 | Germany . |
| 54 097 546 | 8/1979 | Japan . |
| 307726 | 3/1929 | United Kingdom . |
| 893570 | 4/1962 | United Kingdom . |

*Primary Examiner*—Laura Edwards

*Attorney, Agent, or Firm*—Collard & Roe, P.C.

[57] ABSTRACT

The cylinder running surfaces of an internal combustion engine are treated with pretreatment and coating baths by using flush-in devices (5, 11) with lances insertable into the cylinder bores (1'). The flush-in devices (5, 11) can be successively connected via manifold devices (10, 12) with reservoirs ($V_1$ to $V_5$; $B_1$ to $B_3$) for different bath liquors. Thus, each flush-in device (5, 11) serves for the successive introduction of different bath liquors into the cylinder bores (1').

13 Claims, 6 Drawing Sheets

DEVICE AND PROCESS FOR PRODUCING REINFORCING LAYERS ON CYLINDER RUNNING SURFACES OF INTERNAL COMBUSTION ENGINES AND THE LIKE

BACKGROUND OF THE INVENTION

1. Field of the Invention

The invention relates to a device as well as to a process for producing reinforcing layers in particular on cylinder running surfaces of the cylinder bores especially of light metal cylinder blocks and the like in connection with internal combustion engines and the like, by successively introducing treatment and coating baths into the cylinder bores.

2. The Prior Art

Such devices or methods are basically known and used primarily in the manufacture of such internal combustion engines having a cylinder block consisting of light metal, in particular of aluminum or an aluminum alloy.

In this connection, a nickel dispersion layer is produced, as a rule, for increasing the resistance to wear of the cylinder running surfaces.

For producing such dispersion layers, immersion processes are known in which the entire cylinder block is successively placed in different baths by means of suitable manipulators.

Said process is disadvantageous to the extent that when the cylinder block is transferred from one bath into the other, relatively much bath liquor is carried along from the preceding bath. In addition, unnecessarily large surfaces of the workpiece come into contact with the bath liquors.

It is known from DE-OS 39 37 763 to treat only the cylinder running surfaces with the baths by introducing the respective bath liquors into the cylinder bores. For this purpose, the cylinder block is arranged on a sealing plate, which serves as the workpiece carrier, and which is transferred together with the cylinder block between the various treatment positions at the various baths. The sealing plate, which is arranged on the cylinder head side of the cylinder block pointing downwardly during the bath treatment, has openings that are coaxial with the cylinder bores, so that the sealing plate can be lowered together with the cylinder block in the treatment positions onto vertical spraying or flushing tubes, by means of which the respective bath liquor is then flushed into the cylinder bores.

It is made possible in this way that the bath liquors are only admitted to the surfaces of the workpiece that are to be reinforced.

However, all the methods specified above have the drawback that the cycle times for transferring the cylinder block between the individual baths can not be synchronized in a desirable way with the respective bath treatment times. While some bath liquors have to or may act on the cylinder running surfaces only for a short time, other bath liquors have to act for clearly longer time periods. This leads to the fact that the longest treatment time determines the cycle times for transferring the cylinder block from one bath to the next. It has to be accepted in this connection that the cylinder block clearly dwells longer in some baths than would be necessary for the treatment with the respective bath liquor. This, however, is basically undesirable because it means one necessarily has to put up with the fact that individual bath installations are clearly used below their capacity.

A further problem of the processes known heretofore is that particularly with engines with a V-shaped cylinder arrangement. The two cylinder rows, because of the upwardly open process space, have to be vertically aligned one after the other for the coating process, which highly increases the time expenditure.

Additional drawbacks of the upwardly open process space are an increased risk of contamination and the limited possibilities for influencing the flow conditions in an open process space.

SUMMARY OF THE INVENTION

Therefore, an object of the invention is to create a novel device, which permits the bath-technological manufacture of reinforcing layers at comparatively low expenditure and avoids the drawbacks of an upwardly open process space.

According to the invention, the object is achieved wherein the bath liquors are admitted into the cylinder bores by means of flush-in devices. These devices by way of a manifold arrangement, are connectable with a plurality of basins of reservoirs for the treatment or coating baths to be admitted into the cylinder bores one after the other. Thus, the flush-in devices have lances, which are insertable into the cylinder bores from one side. These bores are fitted with closing pieces, by means of which the cylinder bores can be sealed liquid-tight at their two face ends.

Thus the invention is based on the general idea of using one single flush-in device for the successively occurring admission of different treatment or coating baths into the cylinder bores. Also there is sealing the process space by closing pieces, whereby the sealing of the cylinder bores on both sides is carried out by means of lances. These lances can be pushed into the bores on one side, with closing pieces mounted on said lances.

In this way, it is possible in an advantageous manner to admit the bath liquors into the cylinder bores even if the bores are aligned slanted relative to the vertical in the respective treatment stations. Accordingly, cylinder bores of engines with a V-cylinder arrangement can be easily coated as well without having to align the cylinder rows vertically one after the other.

Special advantages of the invention are that the system according to the invention is capable of operating economically also with relatively small series. The pressure in the process space can be varied. The cylinder bores do not have to be accessible on both sides in order to delimit the process space by the closing pieces.

As a rule, it is useful to make provision for two flush-in devices. The first flush-in device serves for the pretreatment of the running surfaces of the cylinder bores with different pretreatment baths. The actual treatment baths are admitted into the cylinder bores by means of the second flush-in device. It is made possible in this way that all parts of the flush-in devices coming into contact with the bath liquors can be manufactured from comparatively inexpensive materials , because since a flow of electric current has to be generated between parts of the flush-in devices and the walls of the cylinder bores as the coating baths are being admitted, the lances or parts of the latter have to be made of electrically conductive materials which, as a rule, are chemically not resistant to the pretreatment baths.

When two flush-in devices are arranged, it is possible to manufacture the parts coming into contact with the pretreatment baths from electrically nonconductive plastic material.

The parts of the flush-in devices, for example lances or the like, which are electrically connected as anodes in the application of the coating baths, may then consist of lead or lead alloys.

However, it is basically possible also to manufacture the parts coming into contact with the bath liquors, such parts being electrically connected as anodes, from materials that are resistant to all bath liquors, for example from platinized materials such as particularly titanium. In this case, one single flush-in device suffices, by way of which all pretreatment and coating baths can then be admitted into the cylinder bores.

So that the required overall treatment times can be largely adapted to each other especially when using two flush-in devices, it is useful to carry out the pretreatment of the cylinder running surfaces in the following way:

First, a degreasing bath is admitted into the cylinder bores; subsequently, the cylinder running surfaces are pickled with an acid mixture; and the cylinder running surfaces are thereafter subjected to a zincate treatment. The total time of said process steps approximately corresponds with the total time required for the application of the following coating baths if the acid mixture used for pickling contains acids or salts dissociated in hydrogen ions, sulfate ions and fluoride ions, as well as peroxides or peroxide-containing compounds, particularly about

| | |
|---|---|
| 100 to 200 g/L | $H_2SO_4$ |
| 10 to 30 g/L | $H_2O_2$, and |
| 5 to 10 g/L | HF. |

With respect to preferred features of the invention, reference is made in all other respects to the claims and to the advantageous embodiments explained in the following, which are described by reference to the drawing.

Especially in connection with cylinder blocks made of aluminum cast alloys, it has been found that the aforementioned pickling treatment activates the cylinder running surfaces in a surprisingly good way, and that a highly fine-crystalline zinc layer is thus developed in the subsequent one-time only zincate treatment. The adhesion of a coating (reinforcing layer) produced after the zincate treatment is so high that a two-times zincate treatment as commonly applied according to the state of the art can be dispensed with.

Incidentally, is is advantageous in connection with the aforementioned pickling treatment that the latter can be carried out at room temperature. Accordingly, heating energy can be saved. In addition, the evaporation rate is low, so that the exhaust air of the treatment rooms is loaded only slightly even if the baths are operated without bath exhaustion.

As compared to conventional pickling, only a relatively low pickling erosion occurs in the pickling treatment according to the invention, i.e., particularly low tolerances are made possible in connection with the dimensional accuracy of the cylinder bores.

The pickling times are preferably between 20 seconds and 3 minutes, particularly preferred are times betweeen 30 and 60 seconds.

The subsequent depositing of the nickel dispersion layer is preferably accomplished by producing on the cylinder running surfaces a laminar flow of the coating bath, such flow penetrating an annular gap formed between the cylinder running surfaces and an anode of the flush-in device.

By a step-by-step intensification of an electric galvanizing current maintained between the anode and the respective cylinder running surface, across a time span of 0.5 to 1 minute, it is possible at the beginning of the coating to build up a mechanically low-tension base layer, which subsequently permits a higher coating rate according to the increased electrical current intensity. In this connection, it has been found that the following parameters are advantageous:

| Nickel coating bath-Composition | |
|---|---|
| $NiSO_4.7H_2O$ | 500 to 700 g/L |
| $H_3BO_3$ | 40 to 60 g/L |
| Tension reducer | 0.1 to 2 g/L |
| SiC with 2.5 μm graining | 40 to 80 g/L |
| Operating conditions | |
| Temperature | 65° to 90° C. |
| pH | 1.6 to 2.8 |
| Flow | laminar |
| Starting current density | 5 to 20 A/dm$^2$ |

DETAILED DESCRIPTION OF PREFERRED EMBODIMENTS

Figure 1:
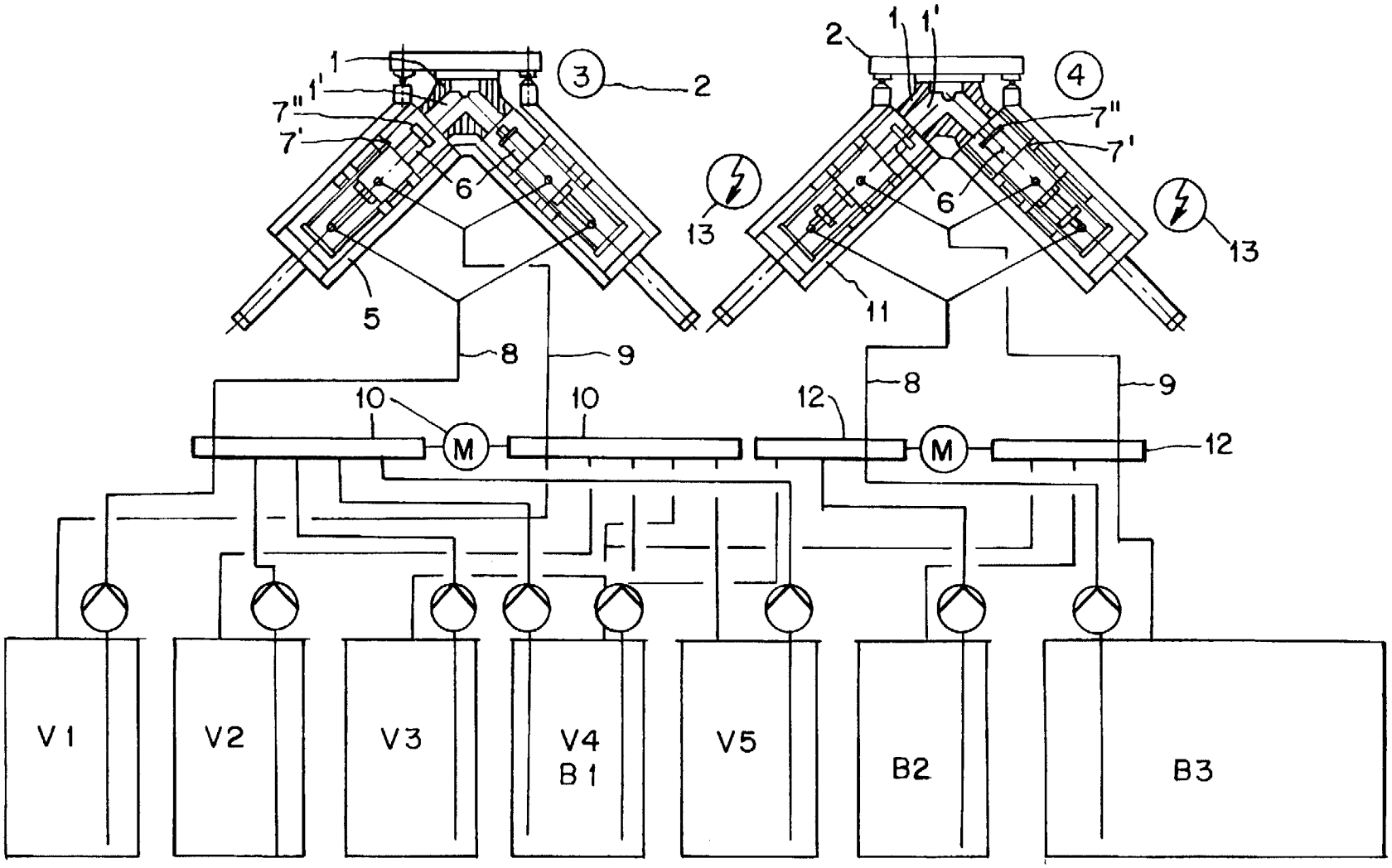
FIG. 1 shows a schematized representation of a complete plant with two flush-in devices.

According to FIG. 1, a V-cylinder block is transported on a workpiece carrier 2 from preceding treatment stations to a pretreatment station 3, and subsequently to a coating station 4, from where the V-cylinder block 1 is then passed on to further production stations.

A first flush-in device 5 is associated with the pretreatment station 3, said device serving the purpose of successively flushing different pretreatment baths into the cylinder bores 1' of the V-cylinder block 1 in order to prepare the cylinder running surfaces for the coating carried out later in the coating station 4.

For said purpose, the flush-in device 5 has the lances 6, which can be inserted in the cylinder bores 1', and which are provided with the closing pieces or closing elements 7', 7", by means of which the cylinder bores 1' can be sealed liquid-tight at their two face ends.

Furthermore, the lances 6 are fitted with the feed and drain conduits 8 and 9, respectively, by way of which different treatment liquors can be admitted into the cylinder bores 1' and drained from the latter, respectively.

Now, an important special feature of the invention is that the feed and drain conduits 8 and 9 of the lances 6 can be successively connected by means of a first manifold device 10 with the different reservoirs $V_1$ to $V_5$ for different pretreatment liquors. If, for example, the feed and drain conduits 8 and 9 are connected via the manifold device 10 with the reservoir $V_1$, a pump associated with said reservoir $V_1$ conveys treatment liquor from the reservoir $V_1$ to the feed conduit 8, so that the respective treatment liquor is admitted into one of the cylinder bores 1' via one of the lances 6. Since the drain conduit 9 is, with the manifold device 10 in said position, connected with a return line leading to the reservoir $V_1$, bath liquor continuously admitted into the cylinder bore 1' is simultaneously returned to the reservoir $V_1$.

Following switching of the manifold arrangement 10, treatment liquor can be subsequently admitted into the cylinder bores 1' from the reservoir $V_2$ in basically the same way.

As soon as all of the cylinder bores 1' have been treated in the pretreatment station 3 with the bath liquors of the reservoirs $V_1$ to $V_5$ associated with said station 3, the V-cylinder block 1 is transferred to the coating station 4.

Another flush-in device 11 is associated with said coating station 4, which device basically operates in the same way as the flush-in device 5 and can be connected in a similar way via a further manifold device 12 with the reservoirs $B_1$ to $B_3$ for different treatment liquors for producing the desired running surface reinforcements of the cylinder bores 1'.

The other flush-in device 11 substantially differs from the first flush-in device 5 in that the lances 6 of the flush-in device 11 can be electrically connected as an anode to an electric current source 13, the other pole of which is electrically connected with the cylinder block 1, the latter being connected as the cathode, so as to be able to generate within the respective treatment liquor in the cylinder bores 1' a flow of electric current.

Figure 2:
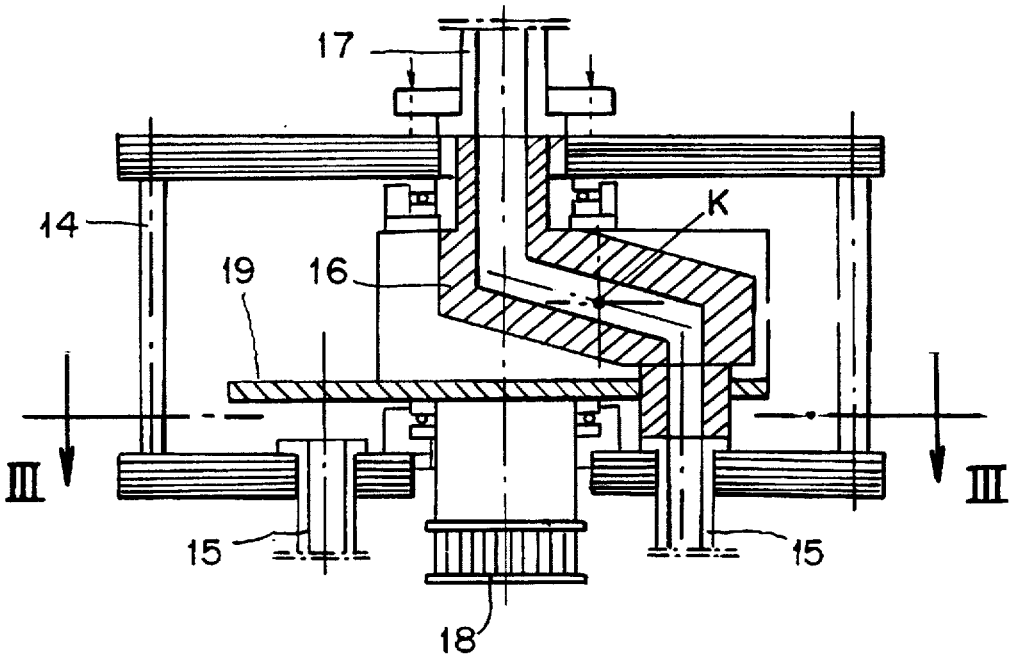
FIG. 2 shows an axial section through a manifold, by which the flush-in devices can be connected one after the other with different reservoirs for different bath liquors.
Figure 3:
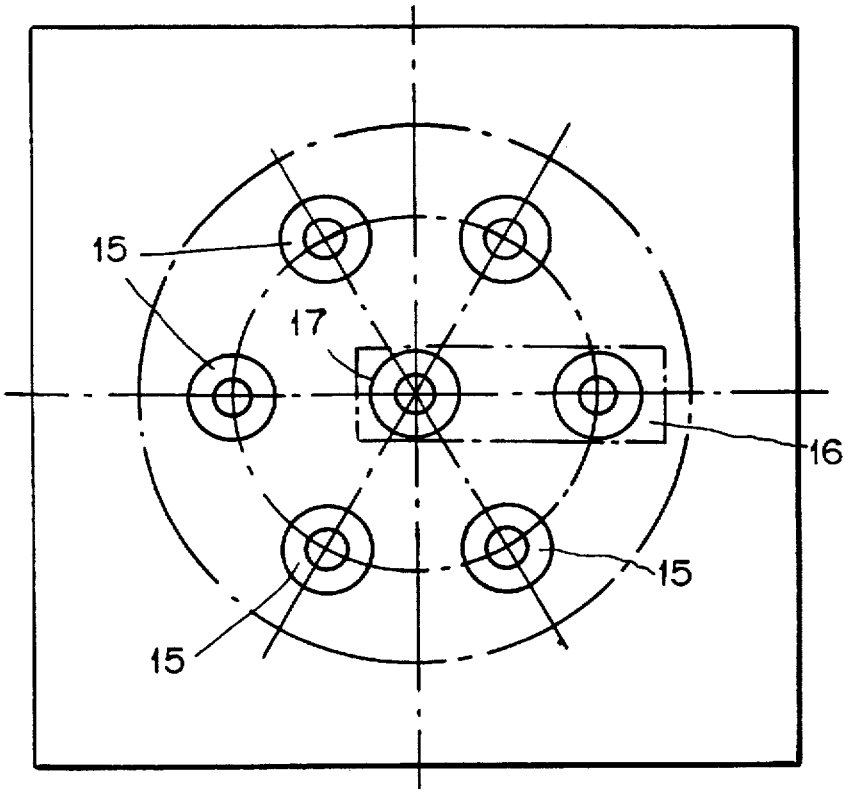
FIG. 3 shows a horizontal section according to the section plane III—III in FIG. 2.

FIGS. 2 and 3 show an exemplified structure of the manifold devices 10 and 12, respectively.

The connections 15 for the feed and return conduits are arranged on the underside of a housing 14; the different reservoirs $V_1$ to $V_5$ and, respectively, $B_1$ to $B_3$ are associated with said conduits. Said connections 15 can be connected via a movable pipeline 16 with a connection 17 on the top side of the housing 14, said connection in turn being connected with the feed conduit 8 and the drain conduit 9 of one of the flush-in devices 5 and 11.

So as to be able to adjust the pipeline 16, a rotary dish 19 fitted with a rotary motor drive 18 is arranged within the housing 15 coaxially with the connection 17, so that the pipeline 16 is swivel-mounted, pivoting around a tilt axis K, the latter being disposed vertically relative to the axis of rotation of the rotary dish 19.

When the rotary dish 19 is adjusted by rotation, the pipeline 16 is swivelled from the position shown around a tilt axis K anticlockwise, so that the ends of the pipeline 16 are removed from the connection 17, as well as from the connections 15. Subsequently, as soon as the rotary dish 19 has reached a position in which the right (in FIG. 2) end of the pipeline 16 has assumed a position neighboring a desired connection 15, the rotary dish 19 is shut down. The pipeline 16 is then pivoted clockwise until the ends of the pipeline 16 are tightly joined with the connection 17 and with the desired connection 15. This establishes the desired connection between one of the connections 15 and with the connection 17.

So as to be able to connect the feed conduit 8, on the one hand, and the drain conduit 9, on the other hand, of a flish-in device 5 or 11 with a desired reservoir $V_1$ to $V_5$, or $B_1$ to $B_3$, two separate rotary dishes 19 have to be arranged in each case with separate pipelines 16, which, in this case, are adjusted simultaneously.

The number of connections 15 with the manifold devices 10 and 12 may vary if different numbers of reservoirs for pretreatment and coating baths are connected to said manifold devices.

Figure 4:
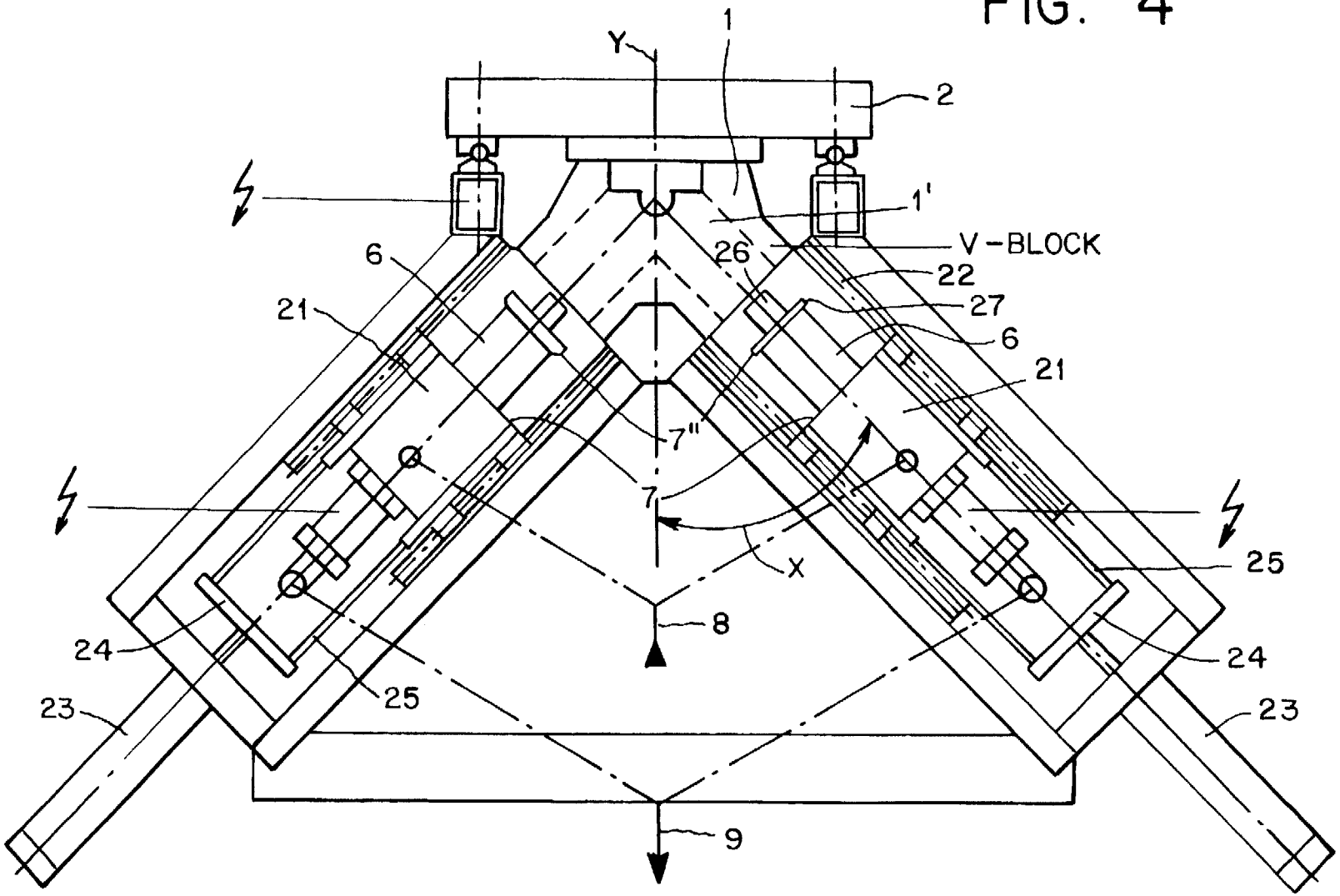
FIG. 4 shows a schematic representation of a coating station for V-cylinder blocks.

According to FIG. 4, the flush-in devices 5 and 11 each have the lances 6 in multiple numbers, such numbers conforming to the number of the cylinder bores 1' of the cylinder block 1.

Each of the lances 6 is arranged within a rack 20 on a lance support 21, such support being arranged displaceably in the way of a carriage on the guide rails 22, sliding in the direction of the axis of one of the cylinder bores 1'. The displacement of the lance supports 21 can take place, for example pneumatically by means of the pneumatic cylinders 23, the pistons of which each are connected in terms of with the associated lance support 21 via a yoke 24 and the rods 25.

FIG. 4 shows that the cylinder block 1 has a vertical axis Y. The flush-in devices 5 and 11 have lances 6. There is means 23 connected to the flush-in devices for axially inserting the lances 6 at an angle X offset from the vertical axis Y into the cylinder bores 1'.

The closing pieces or closing elements 7', 7" are arranged on each lance support 21; with said pieces or elements, the cylinder bores 1' can be sealed liquid-tight at both face ends after the lances 6 have been inserted.

In this connection, a first closing element 7' designed as a sealing ring is arranged directly on the lance support 21, said element cooperating with the cylinder head surface of the cylinder block 1 facing the lance support 21, and being pressed onto the said cylinder head surface by the lance support 21 when the lance 6 is inserted in the cylinder bore 1'. The lower end of the respective cylinder bore 1' is sealed off in this way. The other closing element 7" has a stop 26, which cooperates with elements of the housing in the crank space of the cylinder block as soon as the respective lance support 21 has been advanced sufficiently far against the cylinder block 1. Once the lance support 21 has then reached its final position, in which it is advanced against the cylinder block 1, the stop 26 is retained by said parts of the housing of the cylinder block 1 in a position displaced in the direction of the lance support 20; in said position, a ring seal 27 is radially clamped against the adjacent zone of the cylindre bore 1', as explained hereinafter.

A manifold ring as well as a drain tube are arranged axially between the closing pieces or closing elements 7' and 7"; the bath liquor can be admitted into the cylinder bore via said manifold and drained therefrom via said tube. For said purpose, the manifold ring and the drain tube 29 are connected with the feed conduit 8 and, respectively, the drain conduit 9.

Figure 6:
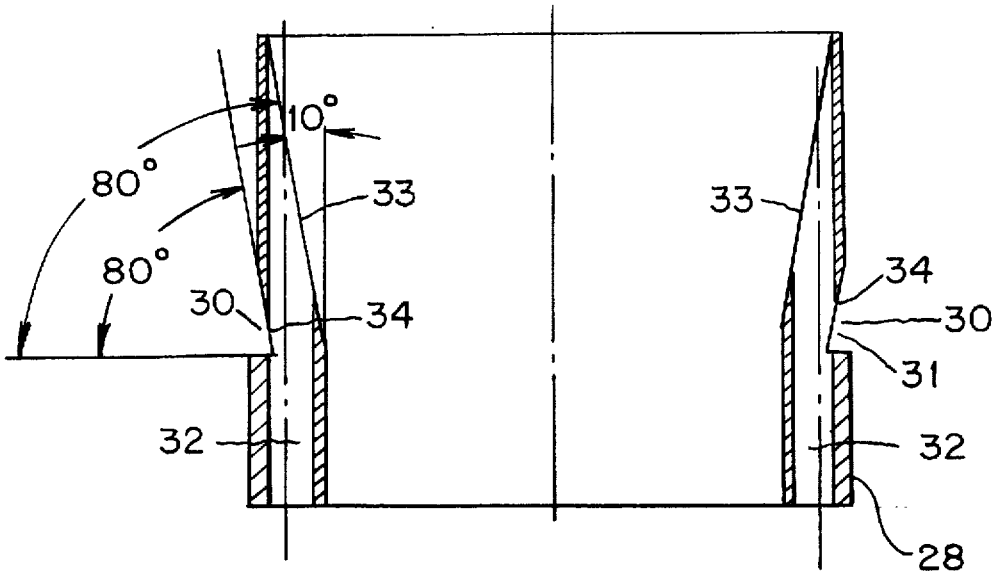
FIG. 6 shows an axial section through a manifold ring for flushing a bath liquor into a cylinder bore.
Figure 7:
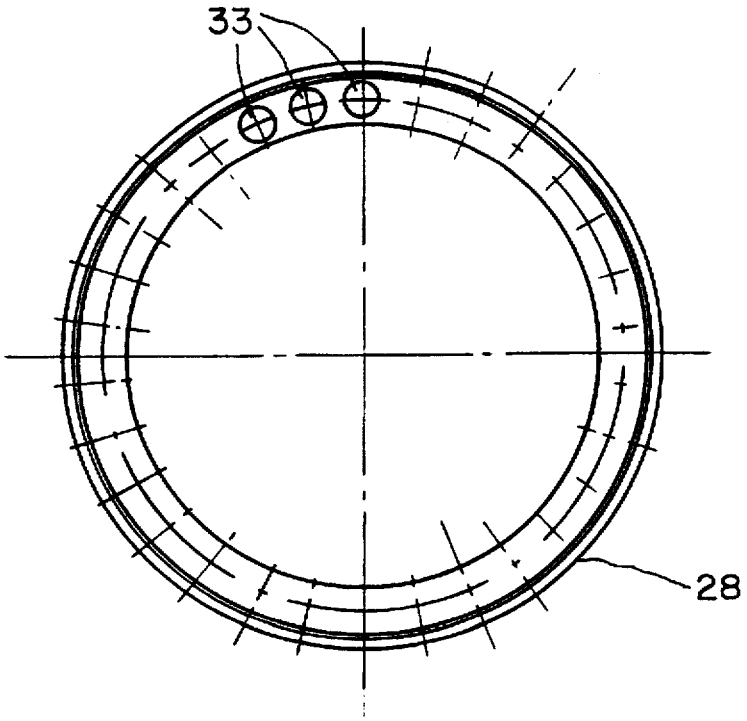
FIG. 7 shows a face view of the manifold ring according to arrow VII in FIG. 6.

According to FIGS. 6 and 7, the manifold ring 28 has the shape of a short cylindrical tube piece, the inner wall of which forming at the end pointing upwardly in FIG. 6 a cone widening toward the end, whereby an angle of about 10° is formed between the cone-like wall zone and a virtual circular cylinder surface. On the outer side of the drain tube 29, a ring stage 30 is arranged between a lower zone (in FIG. 6) with a greater outside diameter, and an upper zone with a smaller outside diameter, said ring stage forming a flank of a V-shaped outer circumference groove 31, of which the other flank is arranged approximately parallel with the cone-like inner wall part.

The manifold ring 28 is penetrated by the axial ducts 32, which are radially arranged between the inner circumferential wall and the outer circumferential wall of the manifold ring 28, with even distribution across the circumference. On the inside of the manifold ring 28, within the zone of the cone-like inner wall part, said ducts 32 have the first orifices 33, and on the side of the outer circumference of the manifold ring 28, the additional orifices 34 within the zone of the annular groove 31, said groove being designed with sufficient depth and being penetrated by the ducts 32.

The ducts 32 are connected with the drain conduit 9—see FIG. 1—and serve the purpose of discharging bath liquors to the outside, such liquors having been admitted into the cylinder bores 1' of the cylinder block 1, and of permitting a laminar flow in the axial direction along the walls of the cylinder bores 1'.

Figure 5:
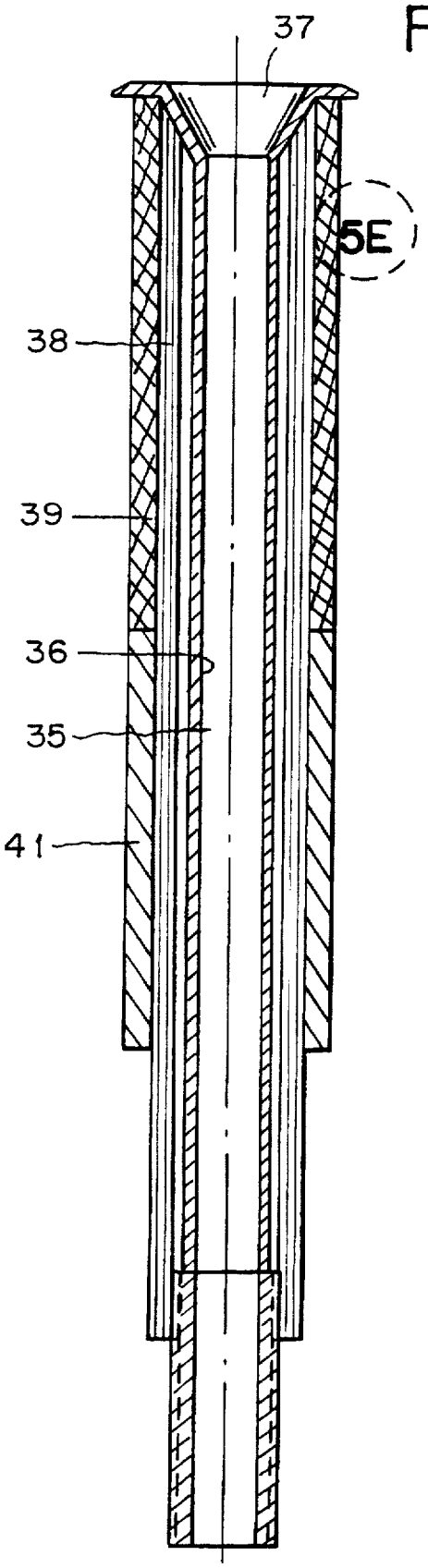
FIG. 5 shows an axial section through a lance designed as an anode for admitting a coating bath into a cylinder bore.

The drain tubes 35 shown by way of example in FIG. 5 serve for admitting the bath liquors into the cylinder bores. Said tubes have an inside tube 36 for feeding the bath liquor, said inside being made, for example of plastic material, and widening like a funnel at its outlet opening 37. The inside tube 36 is jacketed by a carrier tube 38, which primarily serves the purpose of assuring the required mechanical strength of the total arrangement.

At least with the flush-in device 11 (see FIG. 5), the drain tube 35 serves also as an anode. For said purpose, the carrier tube 38 is jacketed by a tubular anode 39 made, for example, lead or the like. Preferably, the outer circumferential surface of the tubular anode 39 is provided with the parallel circumferential grooves 40, which have a substantially round cross section, and which are arranged closely next to each other, in a way such that small bridges are formed between the grooves 40.

Figure 5E:
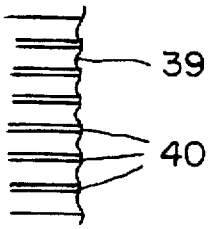
FIG. 5E shows an enlarged view of a portion of the tubular anode.

This is shown in FIG. 5E.

Due to such design of the outer side of the anode, relatively high field intensities are achieved within the zone of the bridges between the grooves 40.

On the side of the tubular anode 39 remote from the outlet opening 37, a cover sleeve 41 made of electrically insulating plastic material is arranged adjoining said side.

The drain tube 35 is concentrically arranged within the manifold ring 28, whereby the outlet opening 37 is disposed close to the closing piece or closing element 7".

When bath liquor is admitted via the inside tube 36 into a cylinder bore 1', and drained from the respective cylinder bore 1' via the ducts 32 of the manifold ring 28, a laminar flow is obtained on the walls of the cylinder bores 1', such flow following a course from the ends of the cylinder bores 1' in the crankcase side, to the lower ends (in FIGS. 1 and 4) of the cylinder bores 1'.

It is basically possible also to operate with a reversed direction of flow by admitting the respective bath liquor via the ducts 32 of the manifold ring 28 and discharging it via the inside tube 36.

If the drain tube 35 needs not to be designed as an anode, for example as in the case of the flush-in device 5, it may be entirely structed from plastic parts.

Figure 8:
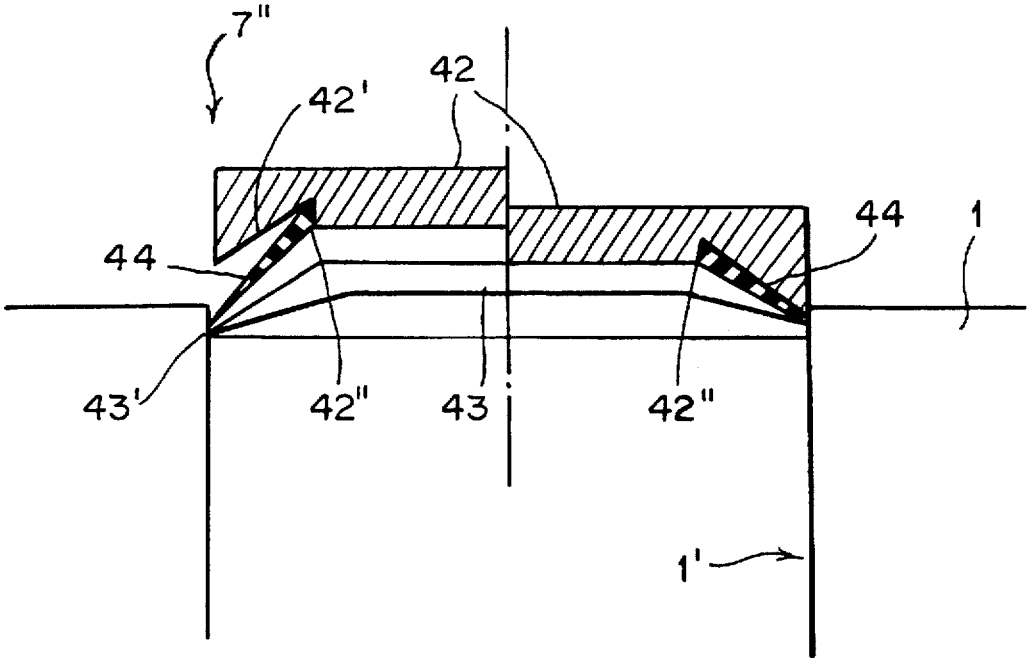
FIG. 8 shows a schematized axial section through a closing piece for the liquid-tight closure of a face end of a cylinder bore.

So that the cylinder bores 1' can be sealed off against the crank space, provision can be made for the closing elements 7" shown in FIG. 8.

Said closing elements substantially consist of the two rigid disks 42 and 43, which can be axially moved relative to each other.

The lower (in FIG. 8) disk 43 has on its top side a cone-like outer marginal zone 43', whereas the upper disk 42 has an outer marginal zone 42' substantially complementing the former. Radially inwardly, the outer marginal zone 42' is adjoined by a ring stage 42".

A substantially funnel-like sealing body 44 is arranged between the disks 42 and 43, said body consisting, for example of an elastomer material. The wall thickness of the sealing body 44 tapers in the direction of the larger funnel opening. With its smaller funnel opening, the sealing body 44 adjoins the ring stage 42" of the disk 42, whereas the edge of the larger funnel opening of the sealing body 44 rests on the radially outer zone of the outer marginal zone 43' of the disk 43. The opening angle of the funnel formed by the sealing body 44 is, in the unstressed condition (cf the left half of FIG. 8), smaller than the opening angle of the cone surfaces 42' and 43'.

When the disks 42 and 43 are adjusted against each other from the axially spaced position shown in the left part of FIG. 8, into the position shown in the right part of FIG. 8, in which the disks 42 and 43 rest one on top of the other, the edge of the larger funnel opening of the sealing body 44 is radially pressed outwardly from between the disks 42 and 43, so that a ring-shaped sealing lip is formed, which seals the annular gap between the wall of the cylinder bore 1' and the disks 42 and 43.

The disk 43 can be arranged fixed relative to the lance support 21 and, for said purpose, can be mounted on the lance support 21, for example by means of rods (not shown). The disk 42, as a stop, may directly cooperate with parts in the crank space of the cylinder block 1, or it may be fitted with a stop 26 (cf FIG. 1), so that the disk 42, when the lance 6 is inserted in the crank space of the cylinder block 1 by said parts, is advanced against the disk 43, and the sealing body 44 can become active as a seal.

The closing element 7" can be used in a different connection as well, for example for sealing the ends of tubes and the like.

What is claimed is:

1. Device for producing reinforcing layers on cylinder running surfaces of the cylinder bores for internal combustion engines having a cylinder block having a vertical axis, comprising flush-in devices for admitting bath liquors into the cylinder bores; said cylinder bores having face ends;

a manifold arrangement for connecting said flush-in devices with a plurality of basins and reservoirs for treatment and coating baths to be successively admitted into the cylinder bores;

said flush-in devices having lances, and means connected to said flush-in devices for axially inserting said lances at an angle offset from said vertical axis into the cylinder bores and said lances are provided with closing pieces by which said cylinder bores are closed liquid-tight on both their face ends.

2. Device according to claim 1, comprising a pretreatment station in which different pretreatment baths are admitted one after the other by means of first flush-in devices; and a coating station in which different coating baths are admitted by means of second flush-in devices.

3. Device according to claim 1, wherein a closing piece with a spreading seal is located on the end of a lance of the flush-in device projecting into the cylinder bore.

4. Device according to claim 3, comprising two dish parts, having dish edges, said two dish parts being axially movable relative to each other and having diameters smaller than the diameter of the cylinder bore;

between said two dish parts is a truncated cone shaped elastomer ring having a wall thickness increasing toward the one face end having the smaller diameter;

said elastomer ring is radially supported on both face edges in a way such that it forms a sealing lip projecting annularly beyond the dish edges as soon as the dish parts are axially clamped against each other.

5. Device according to claim 4, wherein during the insertion of the flush-in device into the cylinder bore, a dish part or an element connected therewith, cooperates as a stop with parts in a crank space or on a crank bearing tunnel of the cylinder block before the flush-in device reaches an axial final position, so that said dish part is axially pressed against another dish part when the flush-in device is completely inserted.

6. Device according to claim 1, comprising a closed circuit means such that the treatment both or coating bath each are at least partly passed through the cylinder bores in said closed circuit for through-flow treatment or through-flow coating, under excess pressure.

7. Device according to claim 1, comprising means for passing the baths through the cylinder bores with a laminar flow.

8. Device according to claim 1, comprising a bath inlet means formed on the parts of the flush-in devices insertable in the cylinder bores, or on their supports, for obtaining a low flow rate by a large flow cross section.

9. Device according to claim 1, comprising lances insertable into the cylinder bores; and anodes tubularly enclosing said lances, said anodes having grooves extending all around and being arranged closely to each other.

10. Device according to claim 9, wherein said grooves have an approximately semicircular cross section.

11. Process for coating cylinder running surfaces of the cylinder bores of an internal combustion engine having a cylinder block having a vertical axis, and comprising the steps of:

producing a laminar flow of a coating bath on the cylinder running surfaces by utilizing a device comprising flush-in devices for admitting bath liquors into the cylinder bores; said cylinder bores having face ends;

a manifold arrangement for connecting said flush-in devices with a plurality of basins and reservoirs for treatment and coating baths to be successively admitted into the cylinder bores;

said flush-in devices having lances, and means connected to said flush-in devices for axially inserting said lances at an angle offset from said vertical axis into the cylinder bores and said lances are provided with closing pieces by which said cylinder bores are closed liquid-tight on both their face ends;

maintaining an electric galvanizing current between an anode in each cylinder bore and the cylinder running surface; and intensifying said current.

12. Spreading seal for sealing cylinder bores of an internal combustion engine, in combination with a device for producing reinforcing layers on cylinder running surfaces of the cylinder bores for the internal combustion engine having a cylinder block having a vertical axis, comprising flush-in devices for admitting bath liquors into the cylinder bores; said cylinder bores having face ends;

a manifold arrangement for connecting said flush-in devices with a plurality of basins and reservoirs for treatment and coating baths to be successively admitted into the cylinder bores;

said flush-in devices having lances, and means connected to said flush-in devices for axially inserting said lances at an angle offset from said vertical axis into the cylinder bores and said lances are provided with closing pieces by which said cylinder bores are closed liquid-tight on both their face ends; and said spreading seal comprising two dish parts having dish edges; and said two dish parts being axially movable relative to each other and having diameters smaller than the diameter of the bore;

between said dish parts a truncated conical elastomer ring having a diameter increasing toward one face end with the smaller diameter being radially supported with both face edges in a way such that it forms a sealing lip annularly projecting beyond the dish edges as soon as the dish parts axially clamped against one another.

13. Spreading seal according to claim 12, wherein the two dish parts have conical marginal surfaces disposed parallel with each other and facing one another, between which the elastomer ring is already clamped when the dish parts are axially clamped against each other.

* * * * *